US006474465B1

(12) United States Patent
Jux

(10) Patent No.: US 6,474,465 B1
(45) Date of Patent: Nov. 5, 2002

(54) BLISTER PACKAGE

(75) Inventor: Egbert Jux, Mainaschaff (DE)

(73) Assignee: Novartis AG, Basel (CH)

( * ) Notice: Subject to any disclaimer, the term of this patent is extended or adjusted under 35 U.S.C. 154(b) by 0 days.

(21) Appl. No.: 09/714,691

(22) Filed: Nov. 16, 2000

(30) Foreign Application Priority Data

Nov. 19, 1999 (EP) ..... 99123049

(51) Int. Cl.[7] ..... A45C 11/04
(52) U.S. Cl. ..... 206/5.1; 206/820
(58) Field of Search ..... 206/5.1, 205, 461–467, 206/471, 484, 820; 134/901; 422/300

(56) References Cited

U.S. PATENT DOCUMENTS

| | | | | |
|---|---|---|---|---|
| 3,311,225 A | | 3/1967 | Kidd | |
| 4,398,634 A | | 8/1983 | McClosky | |
| 5,224,593 A | * | 7/1993 | Bennett | 206/5.1 |
| 5,433,314 A | * | 7/1995 | Lin | 206/5.1 |
| 5,467,868 A | * | 11/1995 | Abrams et al. | 206/5.1 |
| 5,609,246 A | * | 3/1997 | Borghorst et al. | 206/5.1 |
| 5,620,087 A | * | 4/1997 | Martin et al. | 206/5.1 |
| 5,722,536 A | * | 3/1998 | Pierce et al. | 206/5.1 |
| 6,050,398 A | * | 4/2000 | Wilde et al. | 206/5.1 |

FOREIGN PATENT DOCUMENTS

| | | |
|---|---|---|
| EP | 0 299 124 A2 | 9/1987 |
| EP | 0 401 163 A1 | 5/1990 |
| EP | 0 650 676 A1 | 11/1994 |
| EP | 0 734 965 A1 | 3/1996 |
| EP | 0 680 895 A1 | 5/2001 |

OTHER PUBLICATIONS

PCT Search Report.
International Search Report.

* cited by examiner

*Primary Examiner*—Luan K. Bui
(74) *Attorney, Agent, or Firm*—R. Scott Meece; Jian S. Zhou; Richard I. Gearhart

(57) ABSTRACT

The invention relates to a blister package for an optical lens and is concerned with the problem of improving the blister package in such a way that the base parts can be stacked and the work involved in sorting can be substantially reduced. This is achieved by perfecting spacing elements and joining several base parts to one unit (FIG. 2).

21 Claims, 10 Drawing Sheets

BLISTER PACKAGE

The present invention relates to a blister package for an optical lens, especially a soft hydrophilic contact lens, according to the preamble of claim 1.

Soft hydrophilic contact lenses are generally manufactured from hydrophilic polymer material, e.g. copolymers of hydroxyethyl methacrylate (HEMA) and, depending on the polymer composition, may have a water content of 20% to 90% and more. Contact lenses of this kind have to be kept and stored in a sterile solution, normally an isotonic sodium chloride solution, in order to avoid drying out and to keep the lenses ready for use.

A blister package of the generic type designed for this type of soft hydrophilic contact lenses is described in EP 0 680 895 A1. The cavity of this package which accepts the contact lens is not explicitly adapted to the shape of the contact lens. To simplify removal of the contact lens, the cavity has a cap-shaped primary area and a secondary area attached to the side of this, which has the shape of a channel that tapers on all sides away from the primary area, whereby the primary area merges flush with the secondary area, and the primary area and secondary area together have a drop-shaped contour. The base part of the blister package is produced e.g. from polypropylene, usually in an injection moulding or forming process. The base parts are prepared individually and supplied in bulk. In the case of bulk-produced material, the cups are deformed by storing and transporting, with the result that the further packaging procedure may be disrupted. In addition, the work and therefore costs of sorting and supplying the individual cups are very high.

The invention is concerned with the problem of improving the known blister package in such a way that the base parts can be stacked and the work involved in sorting can be substantially reduced.

The blister package according to the invention, which solves this problem, is defined in the independent claim 1. Further structures and developments may be seen in the dependent claims.

By providing the base parts with spacing elements, it is possible to have smooth stacking thereof. Moreover, by connecting several base parts to one packaging unit, it is possible to improve handling of the base parts in the production process.

Further details and advantages of the blister package according to the invention may be seen from the following description of an embodiment with reference to the drawing. In the drawing, FIG. 1 shows an perspective view of a blister package according to the invention;

Figure 1:
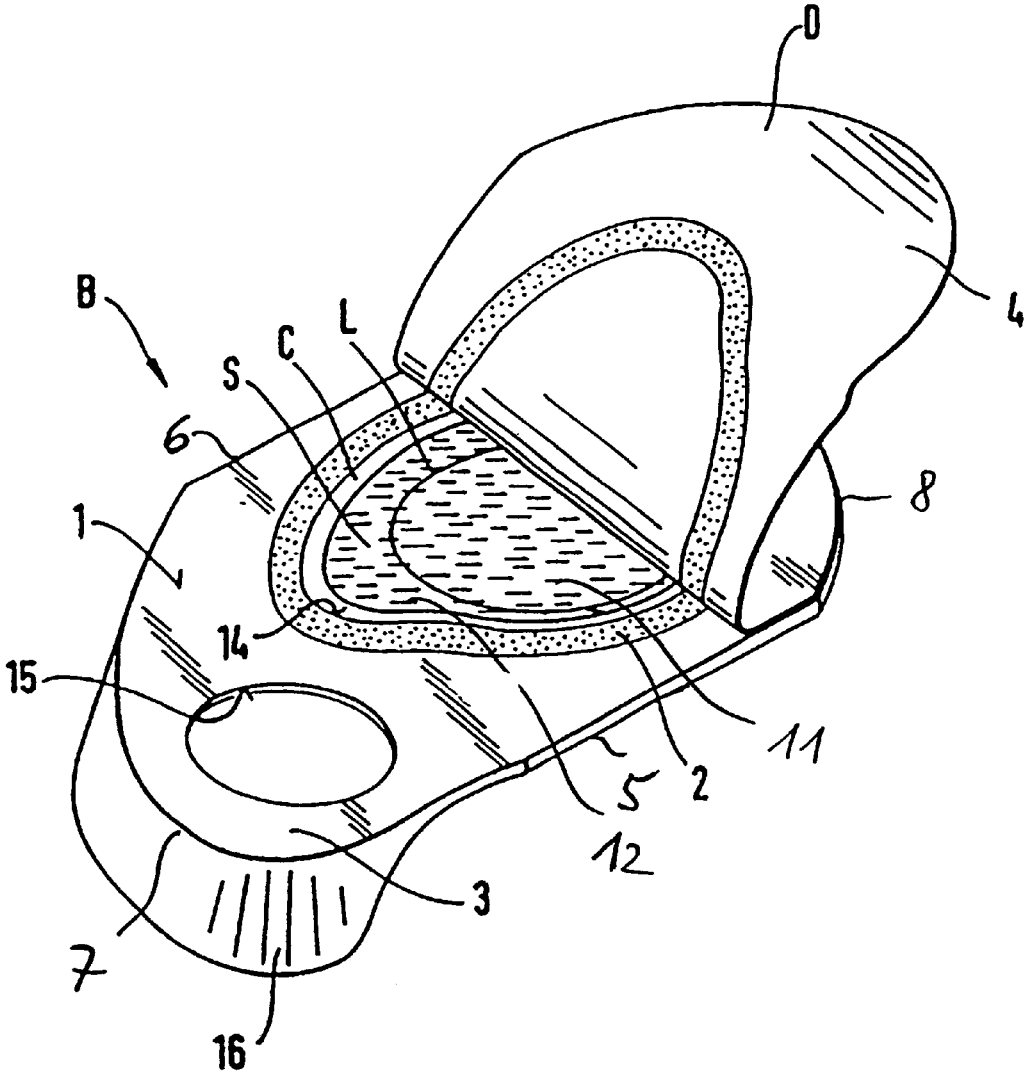

The blister package consists according to FIG. 1 of a base part B and a covering layer D. The base part B includes a cavity C which receives a soft hydrophilic contact lens L and a sterile preserving solution S appropriate to the type of lens, as well as an essentially planar flange 1 which extends out around the cavity C or surrounds it. The likewise flat covering layer D is detachably sealed to the flange 1 in a sealing zone 2 extending around the periphery of the cavity C. On one side of the cavity C, the flange 1 is of broader format and has a gripping area 3, which extends away from the cavity C beyond the sealing zone 2 and is covered by a corresponding gripping area 4 of the covering layer D. In these gripping areas 3 and 4, the base part B or the flange 1 thereof and the covering layer D are not sealed together, so that the covering layer at this point can be simply lifted from the flange and then removed from the base part. The two gripping areas 3 and 4 of the flange 1 and of the covering layer D form gripping means for separating the covering layer from the base part or its flange. In FIG. 1, the illustration of the covering layer D shows it partly removed from the base part. The base part B can be manufactured in an injection moulding or forming process e.g. from polypropylene, which advantageously contains no mould release medium, is non-toxic and in addition can be autoclaved at 121° C. The wall thickness is designed so that losses of the preserving solution through the escape of water vapour lie within fixed limits. The covering layer D may be e.g. a laminate of an aluminium film and a polypropylene film.

The covering layer may be imprinted with details of the contact lens contained in the package or with other information for the end user or the retailer. The covering layer can be sealed to the base part or flange thereof by means of temperature or ultrasonic treatment or by another appropriate adhesion method.

In the broadest sense, the flat flange 1 is of approximate rectangular shape and is bordered on both sides by two parallel, essentially straight edges 5 and 6. On its two other sides, the flange 1 is bordered by a curved front edge 7 and a curved rear edge 8. The relative terms "front", "rear" and "lateral" refer in general herein and hereinafter to the longitudinal axis of the flange 1 or of the blister package, defined by the centre line M between the two straight bordering edges 5 and 6, "front" meaning the part of the flange 1 containing the gripping area 3. Correspondingly, the rear area of the base part B or its flange 1 is understood to mean the area of the base part B or of its flange 1 which is opposite the gripping area 3 in respect of the cavity C. Consequently, the two straight bordering edges 5 and 6 are in a lateral position. The upper side is understood to be the side of the base part B which has the covering layer D, and the lower side is correspondingly the side of the base part facing away from the covering layer D and lying opposite the upper side.

The cavity C which receives the contact lens and the preserving solution is located in the rear and middle area of the base part. The cavity C preferably consists of two sections which merge continuously and smoothly. The first section of the cavity C is an essentially cap-shaped main area 11, the dimensions of which are chosen so that it can receive contact lenses of all current sizes. A practical value of the diameter of the main area 11 measured on the plane E of the flange 1 is e.g. ca. 20 mm, and a practical value for he depth of the main area measured in respect of the plane E of the flange 1 is ca. 6 mm. The second section of the cavity C is a secondary area 12, the shape of which can be best compared with a tapering or funnel-like channel, which becomes continuously narrower and flatter as it leaves the main area. The sides and front of this secondary area 12 are joined to the main area 11, and as already mentioned, merge smoothly with it. Therefore, in reality, the separating line 12 between the two sections of the cavity, discernible in FIG. 1, is of visible. The geometric shape of the secondary area 12 is such that the main area 11 and the secondary area 12 together, that is, the cavity C, have an unsymmetrical drop-shaped contour on the plane E of the flange 1. The peak 14*a* of the "drop" is therefore approximately on the center line M or longitudinal axis of the base part and points towards the gripping area 3 of the flange 1. Around the periphery or contour 14 of the cavity C is the above-mentioned sealing zone 2. Owing to the drop shape of the contour 14, the sealing zone similarly has a peak 2*a,* where the removing movement begins and which simplifies removal.

The drop shape of the cavity C allows the lens to be removed very simply and easily. There is only an extremely small residual volume which is not occupied by the lens, so that only an extremely small amount of preserving solution is needed to preserve the lens.

In contrast to the rear area of the flange 1, the front area thereof, i.e. its gripping area 3, has a preferably unsymmetrical and rounded shape in respect of the center line M, and basically has the form of a rounded saw tooth having a steeper (i.e. lesser inclination to the center line M) and a flatter (i.e. greater inclination to the center line M) convexly curved flank 7*a* and 7*b* and a rounded peak 7*c* between the two. The rounded peak 7*c* lies approximately in the center between the center line M and the straight lateral bordering edge 5. The steeper flank 7*a* blends into a slightly concavely curved section 7*d,* to which the straight lateral bordering edge 5 is joined. The two flanks 7*a* and 7*b,* the rounded peak 7*c* and the concave edge area 7*d* together form the curved bordering edge 7 of the front area 3 of the flange 1.

Approximately in the center between the rounded peak 7*c* of the gripping area 3 and the peak 14*a* of the drop-shaped contour 14 of the cavity C, there is an aperture in the flange 1 which is of essentially oval or elliptic shape. The longitudinal axis thereof conveniently encloses an angle of about 60° with the center line M. The size of the aperture 15 is of such dimension that the ball of the finger of the person handling the blister package can partly grip through it and in this way can lift the opposing gripping area 4 of the covering layer D from the gripping area 3 of the flange 1. The covering layer D can thus be comfortably grasped and removed from the base part B. In addition, the aperture 15 provides a secure grip when holding the blister package in the hand.

In the gripping area 3 of the flange 1, a front support element 16 bends away from the plane E of the flange 1. At both sides of the rounded peak 7*c* of the gripping area 3, this element extends into the flanks 7*a* and 7*b* of the front curved bordering edge 7 of the gripping area 3 and is inclined slightly outwards towards a direction N vertical to the plane E of the flange 1. The support element 16 has a lower bordering edge 16*a* parallel to the plane E of the flange 1 and two sweeping lateral bordering edges 16*b* and 16*c*. The blister package thus rests on the support element 16 and the bottom of the cavity C.

Owing to its special shape and disposition, the front support element 16 also simultaneously serves as an aid to obtaining a comfortable and secure grip on the blister package. Owing to the shape of the base part, a user grips the blister package intuitively, so that he places his index finger under the gripping area 3 between the front support element 16 and the peak 14*a* of the drop-shaped cavity C and presses from outside with his thumb against the front support element 16. The described special shaping of the gripping area 3 and of the front support element 16 is thereby very ergonomic and enables the blister package to be held comfortably and securely while removing the covering layer D from the base part B.

Figure 2:
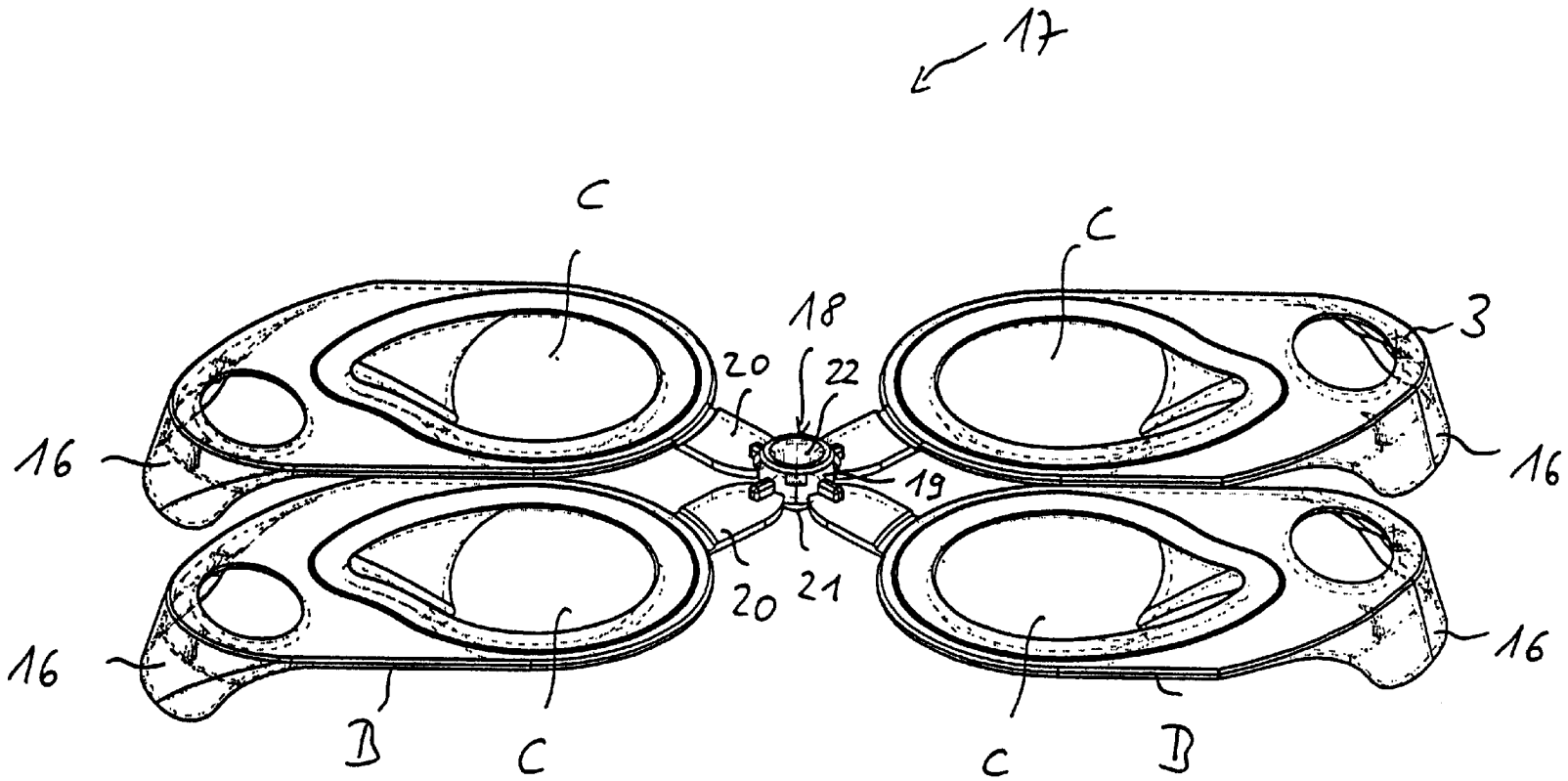
FIG. 2 shows an perspective view of four base parts according to the invention that are joined together.
Figure 3:
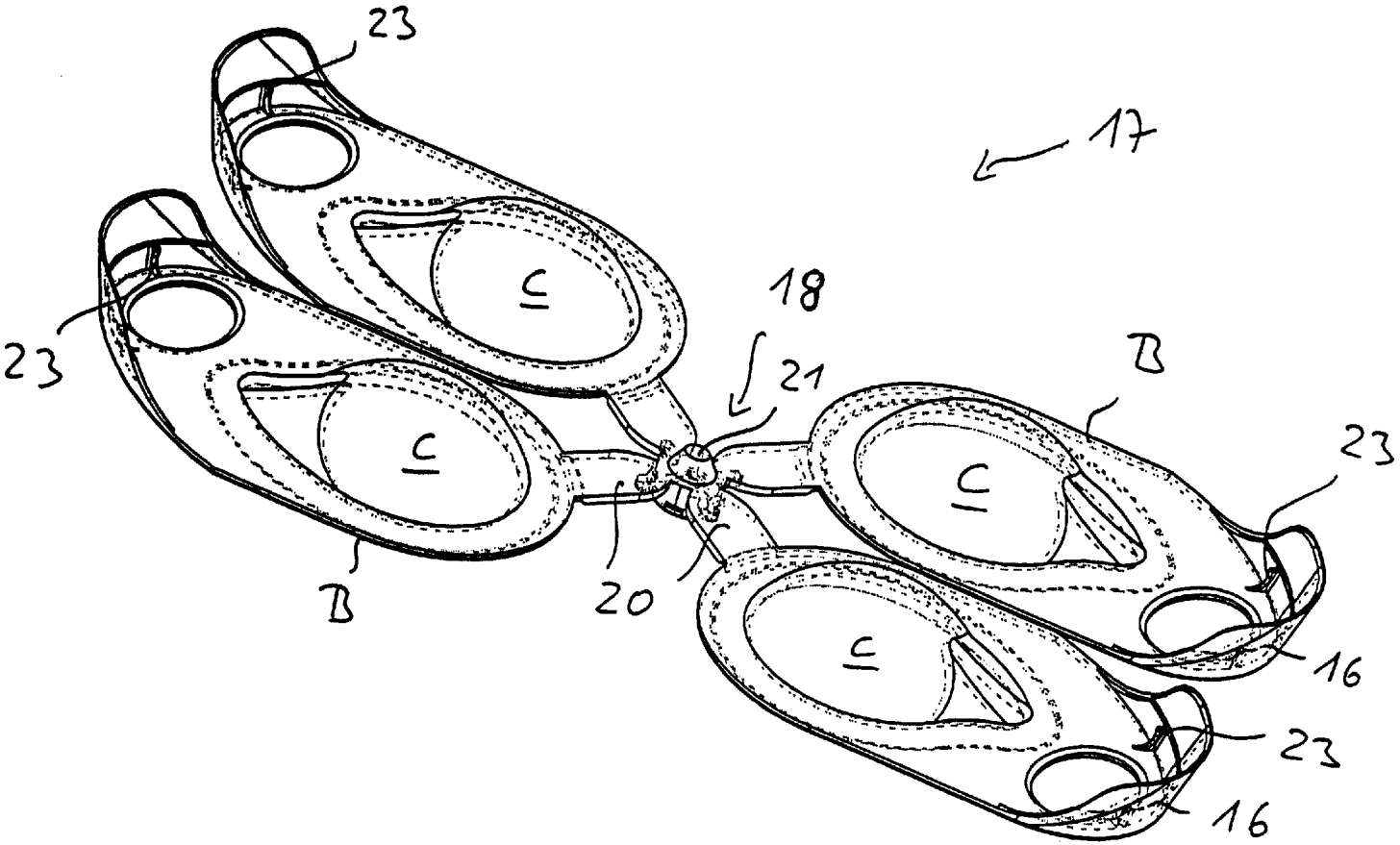
FIG. 3 shows a rear view of the base parts of FIG. 2.
Figure 8:
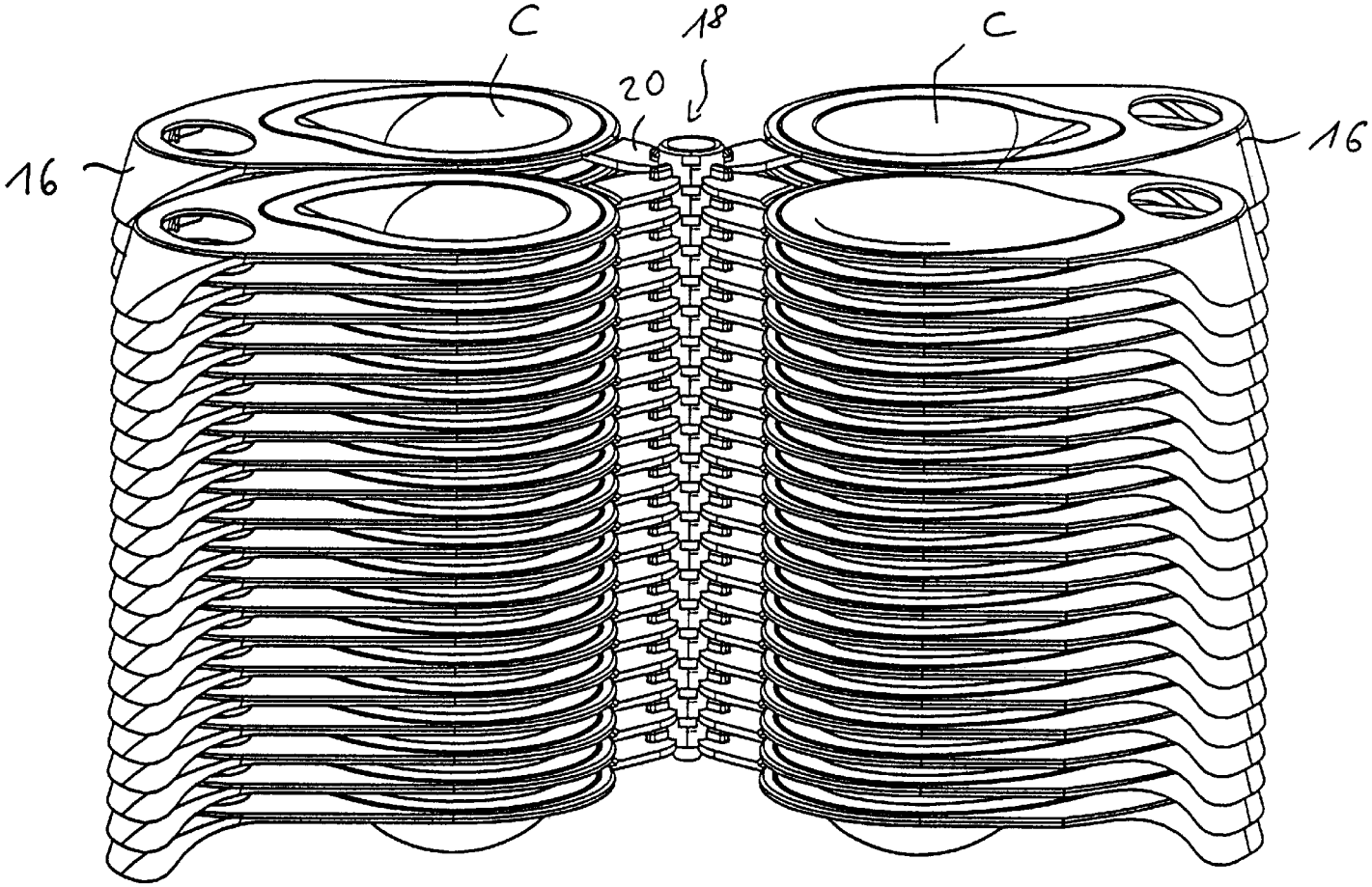
FIG. 8 shows an perspective view of several base parts which are stacked on top of one another.
Figure 9:
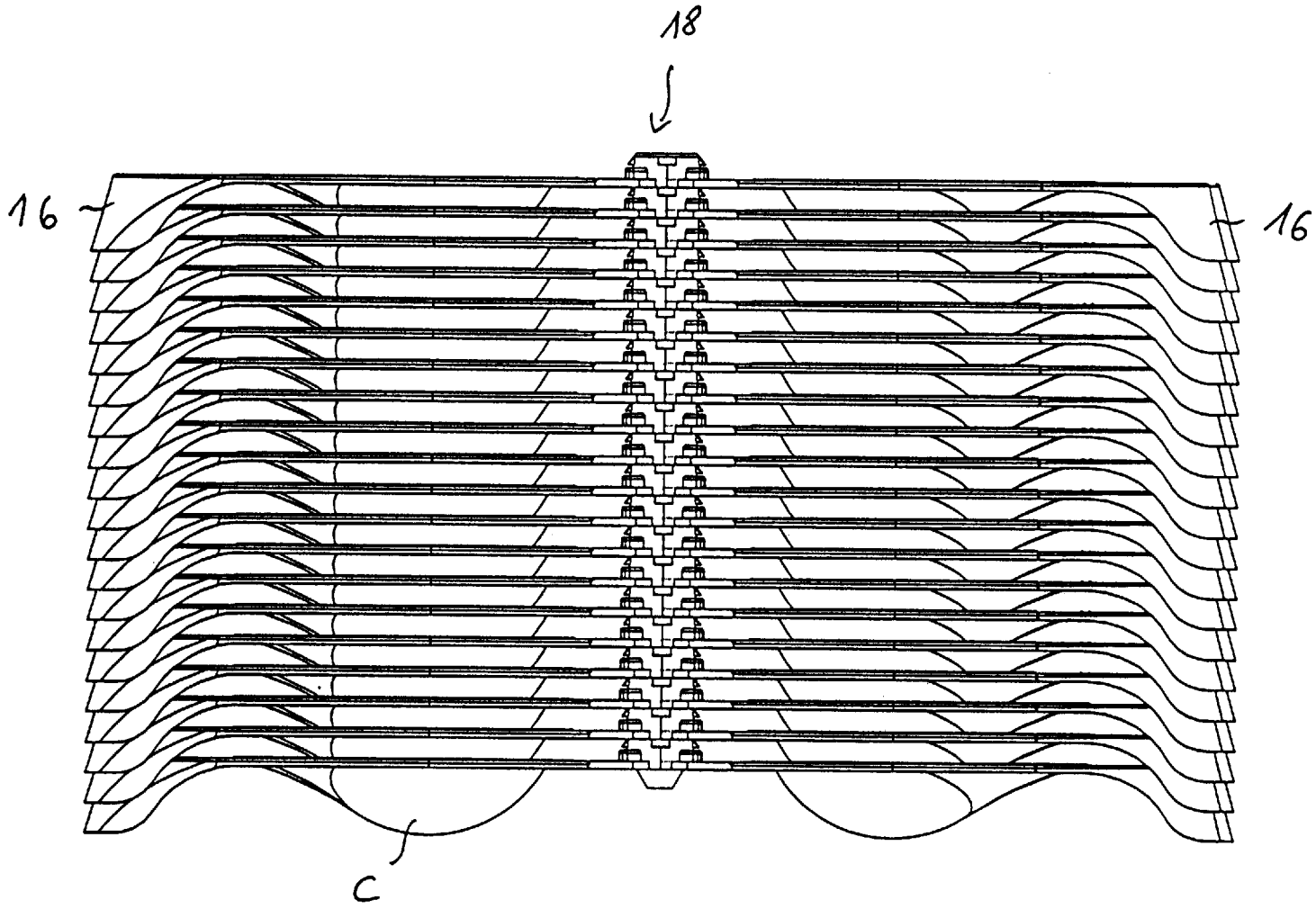
FIG. 9 shows a side view of several base parts which are stacked on top of one another.
Figure 10:
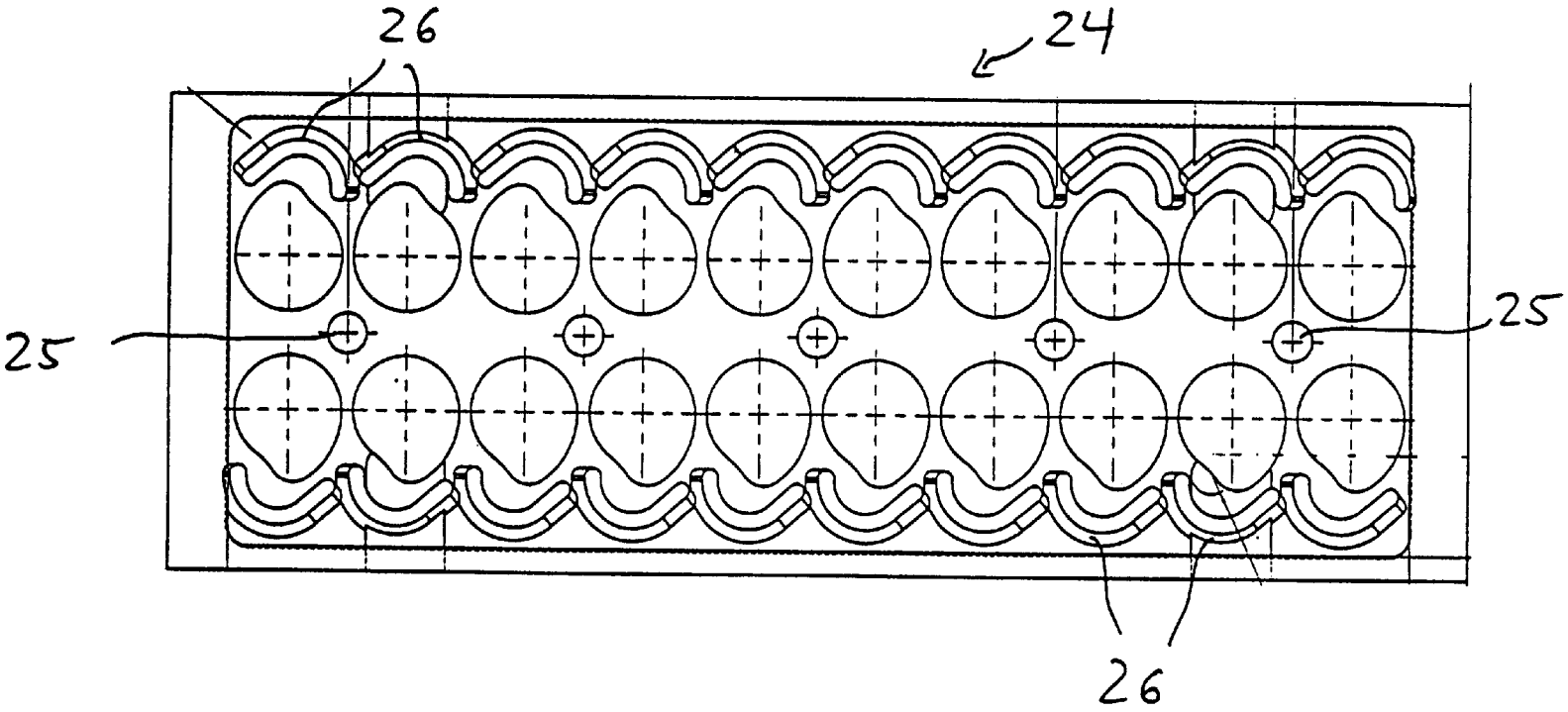
FIG. 10 shows a plan view of a holder for the base parts according to the invention.

As can be seen from FIGS. 2 and 3, four base parts B advantageously form one unit 17, so that handling of the base parts B in the manufacturing process is simplified. The four base parts B are joined together via a connecting element 18, whereby the connecting element 18 consists of a preferably button-shaped centering element 19 and four vanes 20, each of which is connected to a base part B. The length of the vanes 20 determines the space between the opposing base parts B. Moreover, the centering element 19 advantageously forms the moulding point, if the unit 17 is produced by the injection moulding process. It is also conceivable for the moulding point to be provided in another area of the unit. In order to be able to stack the units 17 on top of one another, the centering element is advantageously conical and formed as a truncated cone 21, whereby the opening 22 of the truncated cone 21 is suitably on the side facing the cavity C of the base parts B. However, it is also possible for the opening 22 of the truncated cone 21 to be arranged on the same side as the cavity C. The vanes 20 are arranged approximately in the center of the truncated cone 21. If two units 17 are placed over one another, the inner surface of the truncated cone 21 of the second unit 17 glides over the casing of the truncated cone of the unit 17 underneath. Since the vanes 20 are each arranged approximately in the center of the centering elements 19, they have sufficient space between them during stacking for them not to stick together. So that one unit 17 can be separated again from a stack without trouble and without using force, spacing elements 23 are also advantageously provided on the units. The spacing elements 23 are conveniently provided on the inner surfaces of the front support element 16, so that during stacking the base parts B can be sufficiently spaced apart from one another and can be easily released from one another again. the spacing elements 23 are arranged outside of the cavity C, so that possible rubbing during stacking does not have a negative effect on the contact lens which is moulded in later. The inner surfaces suitably have two spacing elements 23 each, but there may also be fewer or more. Furthermore, the contour of the external and internal casing of the truncated cone 21 is such that they engage with one another when stacked on top of each other, but do not adhere to one another permanently. The height of the spacing elements 23 and the height of the centering unit 19 are advantageously chosen so that a distance of 2.5 mm is maintained when stacked. Because of the interaction of spacing elements 23 in the area of the support element 16 and the conical shape of the centering element 19, it is not necessary to precisely position the units 17 during stacking, as each unit to be stacked finds the correct position automatically as it were. This is of great importance to an automatic manufacturing process. As FIG. 8 shows, a large number of units 17 can be stacked on top of one another. The stacked units 17 may suitably reach a stacked height of ca. 300 mm, so that an extremely large unit number of base parts B can be transported on a palette.

Figure 6:
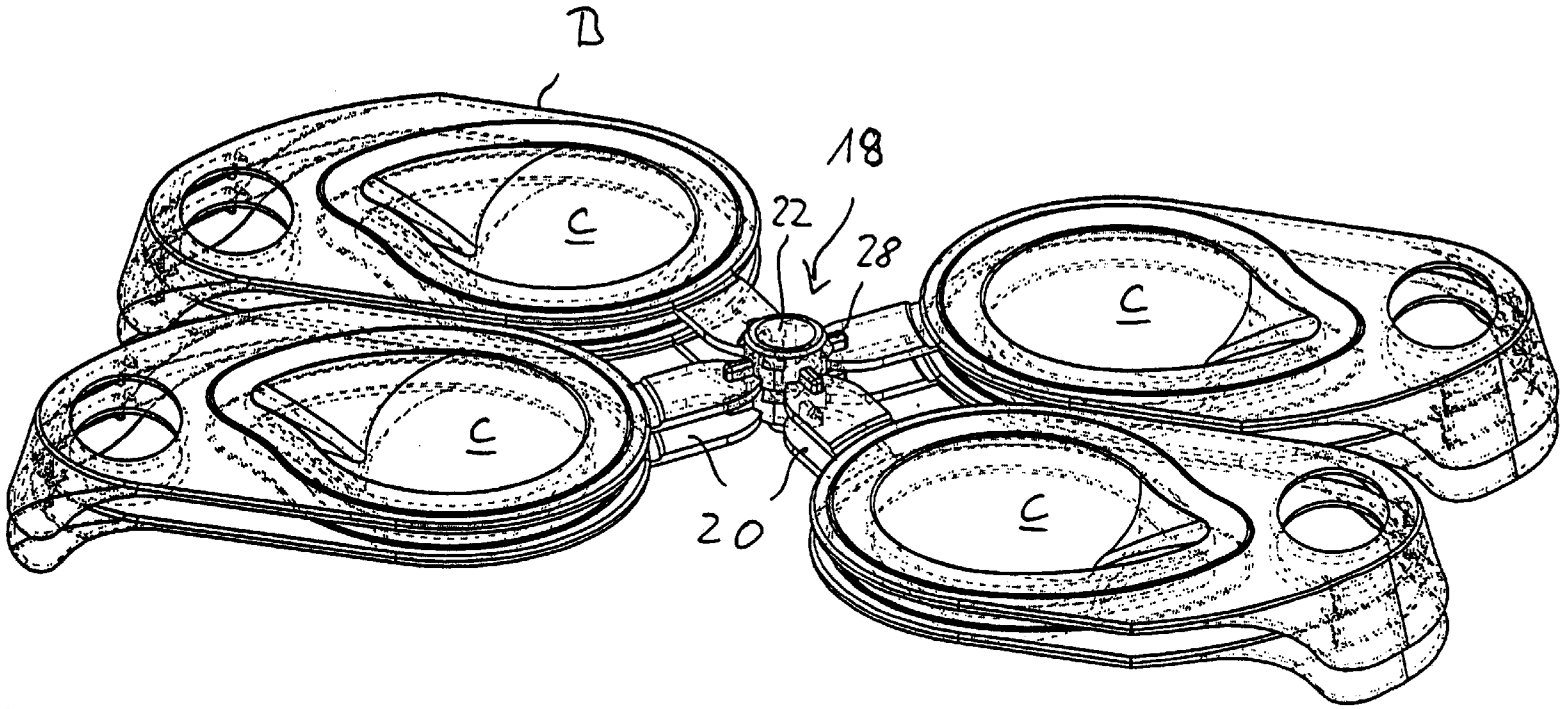
FIG. 6 shows an perspective view of two base parts which are stacked on top of one another.
Figure 7:
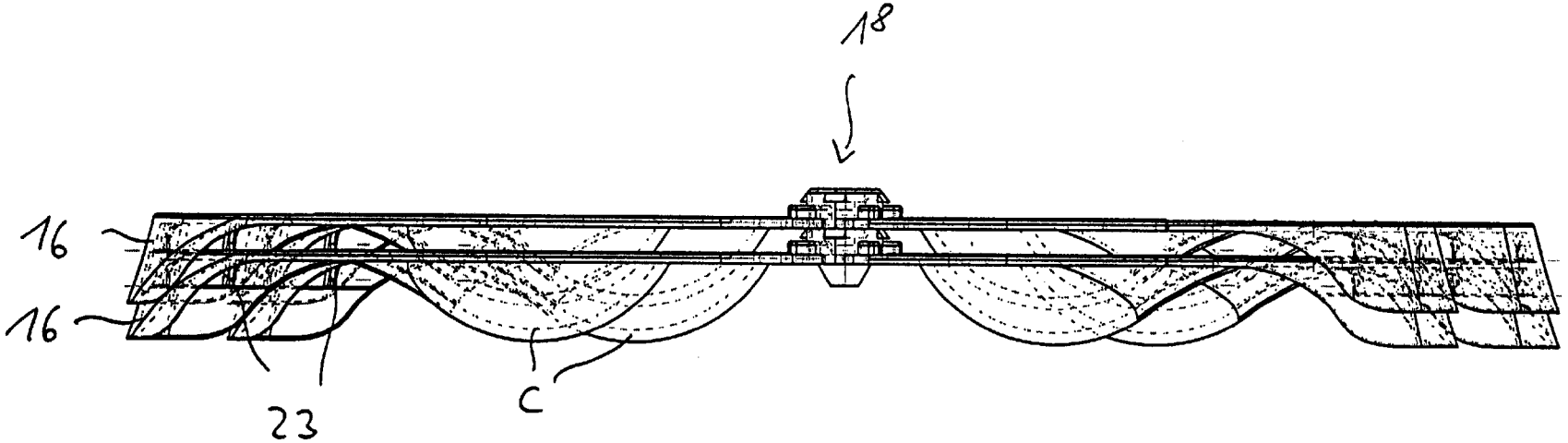
FIG. 7 shows a side view of two base parts which are stacked on top of one another.

In order to package the contact lenses, the units 17 are individually released from a stack and gripped in a holder 24. As illustrated in FIG. 6, the holder 24 has a recess 25 which can be shaped as a borehole, for the centering unit 19 and a mounting element 26 for the support elements 16, so that one unit 17 is clamped firmly in the holder 24 and fixed therein. The holder 24 is advantageously designed so that five units 17 can be fixed. However, it is also conceivable for the holder 24 to be of a larger or smaller dimension.

Figure 4:
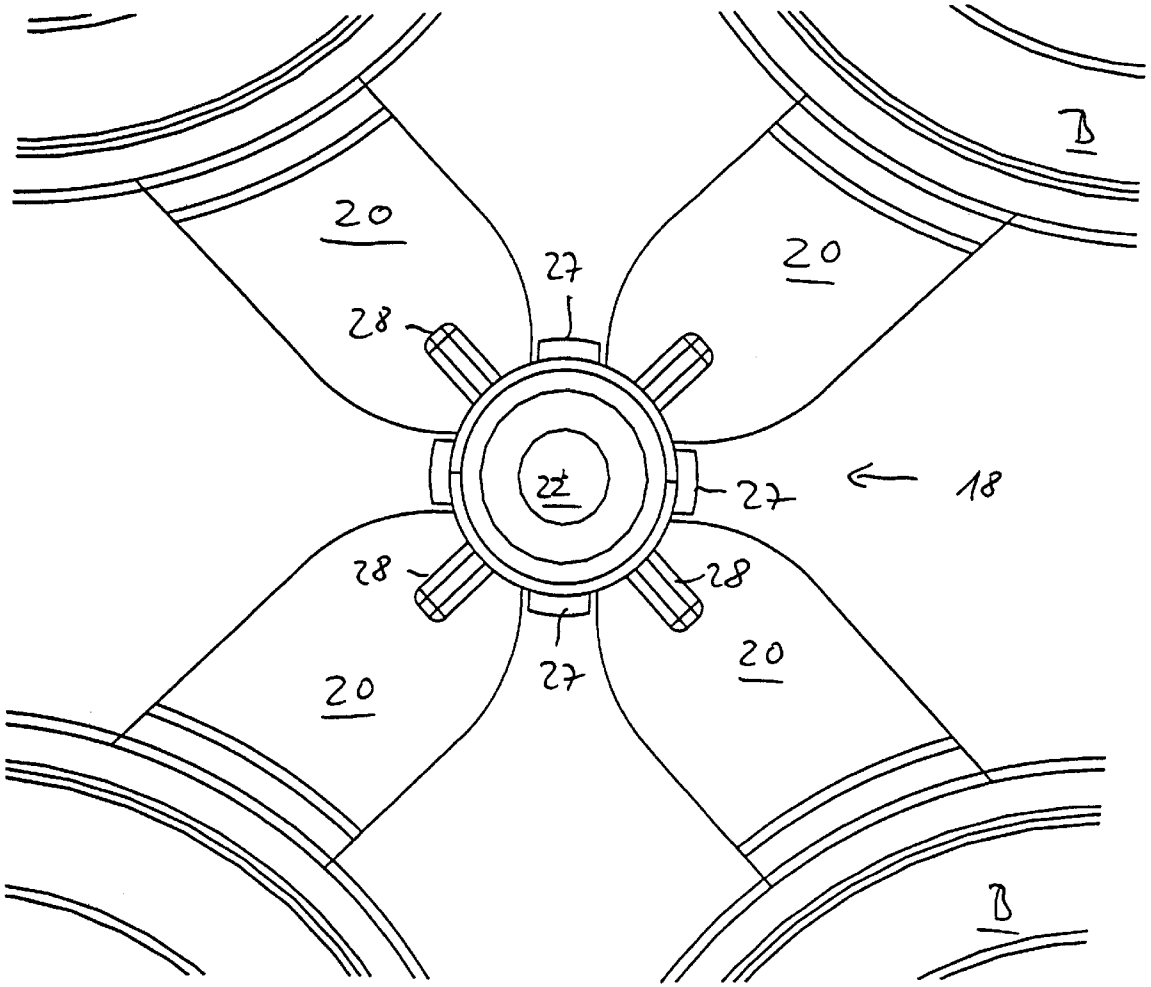
FIG. 4 shows a detailed view of the connecting element of FIG. 3.
Figure 5:
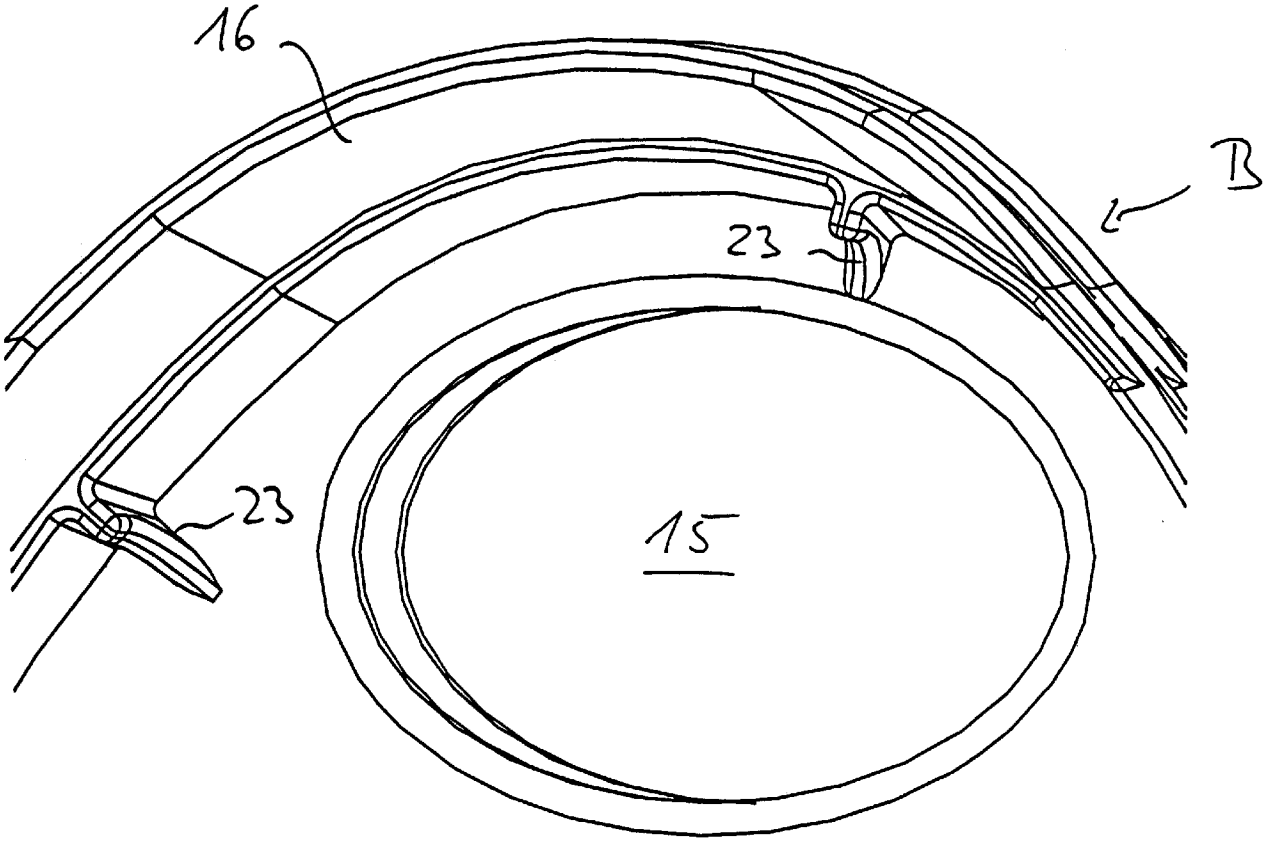
FIG. 5 shows a further detailed view of FIG. 3.

In the manufacturing process, the contact lenses are deposited in the cavities of the base parts and then the preserving solution is added. Then, a cover film D, which has been cut to correspond with the number of units on the holder 24, is placed on all five units. So that this cover film does not ruck up during the subsequent sealing process, the centering element 19 is equipped with fixing means. As is apparent from FIG. 4, four small noses 27 are advantageously provided on the outer casing of the centering element 19, and these serve as clamping elements for the film. When it is applied, the film is pressed below the noses 27 and then kept down by them. Since the film is fixed simultaneously on five centering elements 19, in addition it is also centered. Furthermore, spacers 28 are conveniently provided to prevent the film from resting too close to the flange surface, which can have a negative effect on the sealing process. These spacers 28 are advantageously arranged on the vanes 20 as webs. However, they may also be provided on other areas of the unit 17. After the cover film has been placed on and fixed to the five units 17 held in the holder 24, the film is sealed by a sealing unit along the seam 2 surrounding the cavity C. The area of the sealing seam 2 is advantageously raised, compared with the remaining flange surface of the base part B, thus enabling a uniform sealing seam 2 to be obtained. Subsequently, the sealed units are removed from the holder 24 by a removal device and are cut by a cutting device preferably into blister strips of five blister packages joined together by the cover film. The centering elements 19 and the vanes 20 remain behind as waste products. In the area of the separation joints between the individual base parts, the covering layer D is also conveniently provided with perforation lines for easier separation of the individual packages.

The invention thus provides base parts for blister packages, which can be stacked and enable the packing process to be substantially simplified.

I claim:

1. Blister package for an optical lens, having a base part and a covering layer, wherein the base part includes a cavity and a planar flange extending around the cavity wherein the cavity receives the optical lens and a sterile preserving solution, wherein the covering layer is flat and is detachably sealed to the flange in a sealing zone extending around the periphery of the cavity, wherein the flange has a gripping area at least on one side of the cavity extending away from the cavity beyond the sealing zone, the gripping area of the flange being covered at least partly by a corresponding gripping area of the covering layer without being sealed to it, the gripping areas of the flange and of the covering layer forming gripping means for separating the covering layer from the flange, wherein the flange is provided in its gripping area with at least one front support element bending away from a plane defined by the flange, wherein the front support element prevents the blister package from tilting when the blister package is placed on a flat surface, wherein the base part is provided with spacing elements, wherein at least two base parts are joined together so as to be removable, and wherein the at least two base parts are produced in one piece in an injection moulding process and form one unit.

2. Blister package according to claim 1, wherein during injection molding four base parts are arranged in rectangular fashion and are joined together by a common connecting element.

3. Blister package according to claim 1, wherein the front support element is provided with spacing elements, and wherein the spacing elements are arranged on the inner surfaces of the front support element.

4. Blister package according to claim 2, wherein the front support element is provided with spacing elements, and wherein the spacing elements are arranged on the inner surfaces of the front support element.

5. Blister package according to claim 1, wherein the connecting element consists of a button-shaped centering element and four vanes, each of which is connected to a base part.

6. Blister package according to claim 5, wherein the centering element forms the moulding point in the injection moulding process.

7. Blister package according to claim 5, wherein the centering element is conical and is formed as a truncated cone, wherein the truncated cone has an opening which lies on the side facing the cavity of the base parts or on the side facing away from the cavity of the base parts.

8. Blister package according to claim 7, wherein the vanes are arranged in the center of the truncated cone.

9. Blister package according to claim 5, wherein the centering element is provided with fixing means for the cover film.

10. Blister package according to claim 9, wherein the fixing means are formed as noses which are moulded onto an outer casing of the connecting element.

11. Blister package according to claim 5, wherein the connecting element is provided with spacers for the cover film.

12. Blister package according to claim 11, wherein the spacers are formed as webs molded onto the vanes of the connecting element.

13. Blister package according to claim 1, wherein the sealing zone is raised compared with the remaining surface of the flange of the base part.

14. Blister package according to claim 1, wherein the unit produced in the injection molding process consists of polypropylene, which contains no mould release medium, is non-toxic and can be autoclaved at 121° C.

15. Blister package according to claim 1, wherein the cavity comprises a capshaped primary area and a secondary area attached to the side of the primary area, the secondary area having a shape of a channel that tapers on all sides away from the primary area, the primary area merging flush with the secondary area, and wherein the primary area and secondary area have a drop-shaped contour in a plane defined by the flange, the peak of the drop-shaped contour pointing towards the gripping area of the flange.

16. Blister package according to claim 1, wherein an oval aperture is provided in the gripping area of the flange, allowing the gripping area of the covering layer to be lifted away from the gripping area of the flange.

17. Blister package according to claim 1, wherein the flange in its gripping area and in a rear area opposite the gripping area in respect of the cavity has a curved front bordering edge and a curved rear bordering edge and at both sides of the cavity two parallel straight lateral bordering edges.

18. Blister package according to claim 17, wherein the gripping area of the flange is unsymmetrical in shape in respect of a centre line running parallel in the centre between the two lateral bordering edges, the gripping area of the flange thus having the form of a rounded saw tooth having a steeper less inclined flank and a flatter greater inclined flank in respect of the centre line and a rounded peak between the two flanks.

19. Blister package according to claim 18, wherein two base parts are arranged next to one another in respect of a second centre line, wherein the lateral bordering edge of one base part touches the lateral bordering edge of the other base part, and wherein the connecting element is joined to the respective rear area of the flanges of the base parts, the front support elements thus lying on the side facing away from the centre line.

20. Holder for a blister package according to claim 5, having at least one recess for the centering element of the unit and mounting elements for the support elements of the base parts.

21. Holder according to claim 20, wherein five units can be fixed to the holder.

* * * * *